US009772140B2

(12) United States Patent
Salisbury

(10) Patent No.: US 9,772,140 B2
(45) Date of Patent: Sep. 26, 2017

(54) RETROFIT GRAIN DRYER MOISTURE CONTROLLER

(71) Applicant: Noble M. Salisbury, Chatfield, MN (US)

(72) Inventor: Noble M. Salisbury, Chatfield, MN (US)

( * ) Notice: Subject to any disclaimer, the term of this patent is extended or adjusted under 35 U.S.C. 154(b) by 830 days.

(21) Appl. No.: 13/910,320

(22) Filed: Jun. 5, 2013

(65) Prior Publication Data

US 2013/0298418 A1 Nov. 14, 2013

Related U.S. Application Data

(62) Division of application No. 12/724,270, filed on Mar. 15, 2010, now Pat. No. 8,479,408.

(60) Provisional application No. 61/159,909, filed on Mar. 13, 2009.

(51) Int. Cl.

| | |
|---|---|
| ***F26B 21/06*** | (2006.01) |
| ***F26B 17/12*** | (2006.01) |
| ***F26B 25/02*** | (2006.01) |
| ***F26B 25/22*** | (2006.01) |

(52) U.S. Cl.

CPC ..... *F26B 21/06* (2013.01); *F26B 17/122* (2013.01); *F26B 25/02* (2013.01); *F26B 25/22* (2013.01); *Y10T 29/49716* (2015.01); *Y10T 29/49826* (2015.01)

(58) Field of Classification Search

CPC ..... F26B 21/06; F26B 25/22; F26B 25/02; F26B 17/122; Y10T 29/49716

See application file for complete search history.

(56) References Cited

U.S. PATENT DOCUMENTS

| | | | |
|---|---|---|---|
| 3,946,496 | A | 3/1976 | Sukup |
| 4,249,891 | A | 2/1981 | Noyes et al. |
| 4,599,809 | A | 7/1986 | Parkes |
| 4,750,273 | A | 6/1988 | Parkes et al. |
| 4,896,795 | A | 1/1990 | Ediger et al. |
| 5,144,755 | A | 9/1992 | Braun et al. |
| 5,189,812 | A | 3/1993 | Ediger |
| 5,194,275 | A | 3/1993 | Greer |

(Continued)

OTHER PUBLICATIONS

AgriChem, Inc.; "FP-2 Series Moisture Sensor" Rev1 Mar. 2007.*

(Continued)

*Primary Examiner* — Jacob Cigna
*Assistant Examiner* — Lee A Holly
(74) *Attorney, Agent, or Firm* — Shewchuk IP Services, LLC; Jeffrey D. Shewchuk

(57) ABSTRACT

A retrofit turner and sensor unit includes, on its upper portion, a grain turner for moving grain from a central portion in the grain pathway to a defined outer space for measurement. On its lower portion, the retrofit unit includes a moisture sensor and a temperature sensor provided in a plate configuration in line with the outer wall of the grain dryer for sensing moisture and temperature of grain in the defined space. In the preferred configuration, the plate sensor includes redundancies, and is mounted on a hinged door. The retrofit unit is easily installed into an existing grain dryer with columns and continuous flow capabilities, and electrically connected with a controller/processor and a motor for metering rolls which determine grain speed through the dryer.

19 Claims, 6 Drawing Sheets

(56) References Cited

U.S. PATENT DOCUMENTS

| | | | | |
|---|---|---|---|---|
| 5,437,882 | A | 8/1995 | Greer et al. | |
| 5,570,521 | A | 11/1996 | Baker et al. | |
| 5,651,193 | A | 7/1997 | Rhodes et al. | |
| 6,035,544 | A * | 3/2000 | Morrison | F26B 17/122 34/167 |
| 6,192,750 | B1 | 2/2001 | Greer et al. | |
| 6,249,130 | B1 | 6/2001 | Greer | |
| 6,318,000 | B1 | 11/2001 | Satake et al. | |
| 6,834,443 | B2 | 12/2004 | Bloemendaal | |
| 2002/0032971 | A1 * | 3/2002 | Middaugh | F26B 17/122 34/168 |

OTHER PUBLICATIONS

Agri-Chem, Inc., FT-11 On-Line Moisture Sensor, Jul. 2004, published online at www.agricheminc.com, Ham Lake, Minnesota.

Agri-Chem, Inc., FP-21C Flush Mounted On-Line Moisture Sensor, Mar. 2007, published online at www.agricheminc.com, Ham Lake, Minnesota.

Agri-Chem, Inc., FP-24C Flush Mounted On-Line Moisture Sensor, Apr. 2007, published online at www.agricheminc.com, Ham Lake, Minnesota.

Agri-Chem, Inc., FP Series Flush Mounted On-Line Particulate Moisture Sensor, Apr. 2007, published online at www.agricheminc.com, Ham Lake, Minnesota.

Agri-Chem, Inc., FP-2 Series Moisture Sensor, Mar. 2007, published online at www.agricheminc.com, Ham Lake, Minnesota.

Agri-Chem, Inc., FP Series Particulate Moisture Sensor, Apr. 2007, published online at www.agricheminc.com, Ham Lake, Minnesota.

* cited by examiner

RETROFIT GRAIN DRYER MOISTURE CONTROLLER

CROSS-REFERENCE TO RELATED APPLICATION(S)

This application is a divisional of application Ser. No. 12/724,270, filed Mar. 15, 2010, entitled RETROFIT GRAIN DRYER MOISTURE CONTROLLER, and claims priority from Provisional Application No. 61/159,909, filed Mar. 13, 2009, entitled MOISTURE CONTROLLER FOR GRAIN DRYER.

BACKGROUND OF THE INVENTION

The present invention relates to control of the level of moisture in grain dryers, and to automated or semi-automated moisture controllers used in grain dryers, such as in continuous flow corn dryers. More particularly, the present invention relates to methods and structures for retrofitting existing grain dryers with a control system to regulate the grain dryer to operate to a desired level of moisture in the dried grain.

Freshly harvested grain frequently requires some degree of drying prior to storage to prevent spoilage, and grain dryers are well known in the agricultural arts. In these grain dryers, the removal of too little moisture doesn't adequately preserve the grain, but the removal of too much moisture not only wastes fuel but also can result in excess shrinkage and lightening of the grain. Additionally, the initial moisture of the grain is not always constant, but rather can change from time to time and in different grain samples. Accordingly, many grain dryers include control systems which can adjust the amount of moisture taken out of the grain based upon sensed measurements of the grain. Examples of prior art control systems for grain dryers can be found in U.S. Pat. Nos. 3,946,496, 4,249,891, 4,599,809, 4,750,273, 5,144,755, 5,189,812, 5,570,521, 5,651,193, 6,318,000 and 6,834,443, all incorporated by reference.

Some older moisture controllers in continuous flow corn dryers are temperature based systems. In such older temperature-based systems, when the grain rises to a selected temperature, the grain is presumed to have dried down to the desired moisture content. With these prior art temperature-only based drying systems, a major problem is drying a commodity with a small moisture point removal or small moisture differential being achieved. An example would be if corn comes in from the field at less than 20 percent moisture, with the desired unload moisture being a 15.5 percent moisture content. The grain will not rise to a high enough column temperature to allow the temperature-based system to control the unload system accurately without producing an over-dried product. The prior art temperature-based system thus wastes liquid propane, natural gas and/or electricity in the process, and results in a lower-than-desired final product test weight per volume.

More modern moisture sensing systems (presently marketed by companies such as GSI, Farm Fans (Dry-Tek), Miller and Sukup) include a moisture sensor, which can be calibrated or corrected with a grain temperature measurement. Electrical readings from the sensors are read and interpreted by a controller/processor. One or more metering rolls are located within the grain pathways, driven by a metering roll motor. Based upon measurements taken during the drying process, the controller governs the metering roll motor speed so the grain leaving the grain dryer is at the desired moisture content.

While the modern grain dryers and control systems are beneficial, they have significant limitations and problems. The humidity sensors used are often difficult to keep accurate, with the accuracy problems being exacerbated due to the debris that comes from the commodity or corn. As the commodity gets augured past the sensors, the direction of grain flow will take grain and impurities across the sensor. Cornstalks, cobs and other impurities that come through the dryer can hang up on the sensor or sensor fin due to long stalks or moisture from the drying process. Bees wings or other airborne matter can also build up and stick to the sensor. This build up can change the readings that the sensors/sensor fins receive. When inaccurate sensor readings are provided to the controller/processor, the system will ultimately unload the dryer at an inaccurate speed. The problem will persist if the sensors or sensor fins are not cleaned daily (or more often), which often does not occur in the field.

Cold temperatures outdoors can also keep sensors from giving accurate readings. One known solution to the cold temperature problem is to wrap the sensor, located in the bottom of an auger, with insulation when the outdoor temperature is at or lower than around 15° F. The warmth from the exiting grain warms up the sensor enough to give accurate readings at the controller/processor.

A more pervasive problem with modern grain dryers and control systems stems from the fact that improvements to the control systems are usually made by the same company selling the grain dryer itself, and the control systems improvements are used to market new grain dryers. Grain dryer manufacturers have little incentive to produce systems that will last for decades, when they would rather sell new grain dryers with the latest and greatest control system. Control systems are usually designed and installed as part of the original equipment grain dryer, with little thought put into repair or replacement of the control system, and with little consideration given to use of older grain dryers with malfunctioning or archaic control systems or without any control system in place. Better solutions are needed, particularly for retrofitting older grain dryers in the field or improving the control systems that exist in the field.

BRIEF SUMMARY OF THE INVENTION

The present invention is a retrofit unit specially configured for retrofitting an existing grain dryer with a moisture controller system, as well as the method used and the system created thereby. The retrofit unit includes a grain turner for moving grain from a central portion in the grain pathway to a defined outer space for measurement. The retrofit unit also includes a moisture sensor and a temperature sensor positioned beneath the grain turner for sensing moisture and temperature of grain in the defined space. The retrofit unit allows a simple method of installation, and provides controlled and accurate readings in a robust and long lasting system.

While the above-identified drawing figures set forth preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 1:
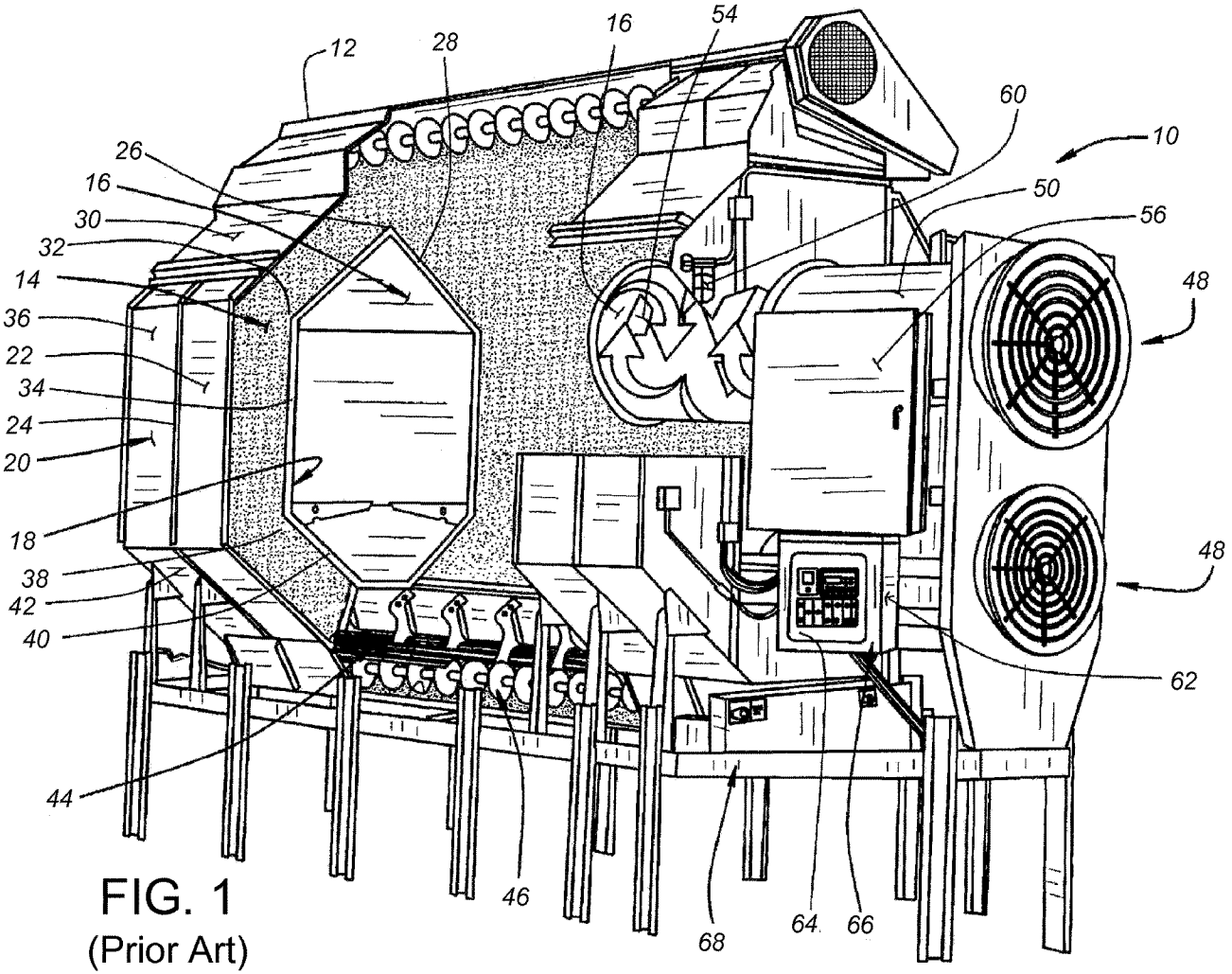
FIG. 1 (Prior Art)
FIG. 1 is a perspective view of a prior art continuous flow grain dryer, typical of what may exist in the field.
Figure 2:
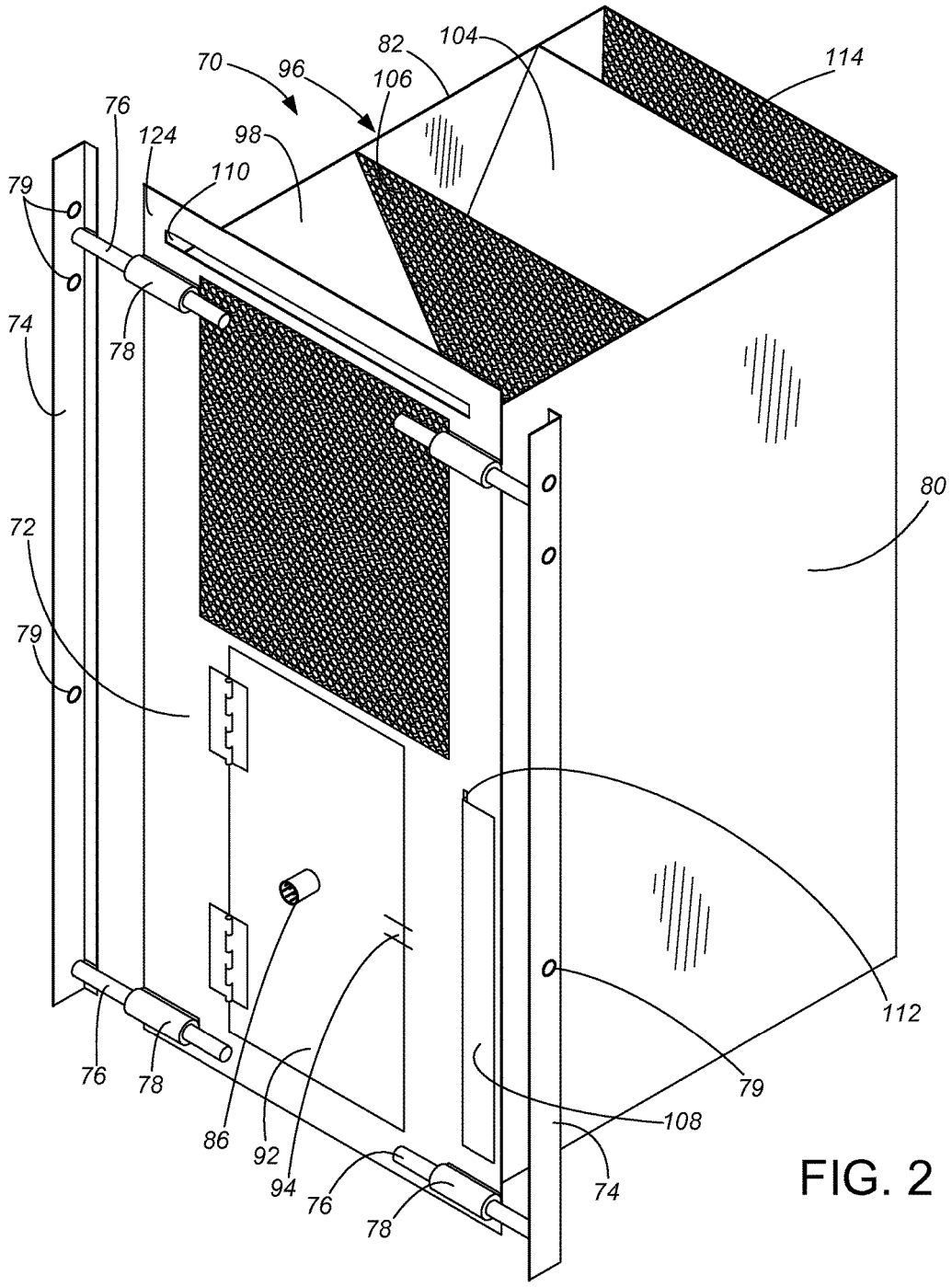
FIG. 2 is a perspective view of the turner and sensor unit used in the retrofit grain dryer moisture controller of the present invention.

In the most common types of existing grain dryer 10 exemplified in FIG. 1, moist grain (typically corn) is gravitationally fed from a grain intake 12 down in two pathways 14 around a central dryer chamber or plenum 16. The two grain pathways 14 are defined between inner and outer baskets 18, 20 formed of perforated screen panels 22 secured between vertically extending columns 24. The grain pathways 14 each proceed downwardly and outwardly from a central apex 26 between inner and outer upper inclined panels 28, 30 to an upper shoulder 32. From the upper shoulder 32, each grain pathway 14 proceeds vertically downward between vertical side panels 34, 36 to a lower shoulder 38. From the lower shoulder 38, each grain pathway 14 proceeds downwardly and inwardly between inner and outer lower converging panels 40, 42 through metering rolls 44 to converge at a discharge auger 46. The openings in the perforated screen panels 22 are sized to confine the grain in the grain pathways 14 but to readily allow forced air crossflow therethrough.

Figure 7:
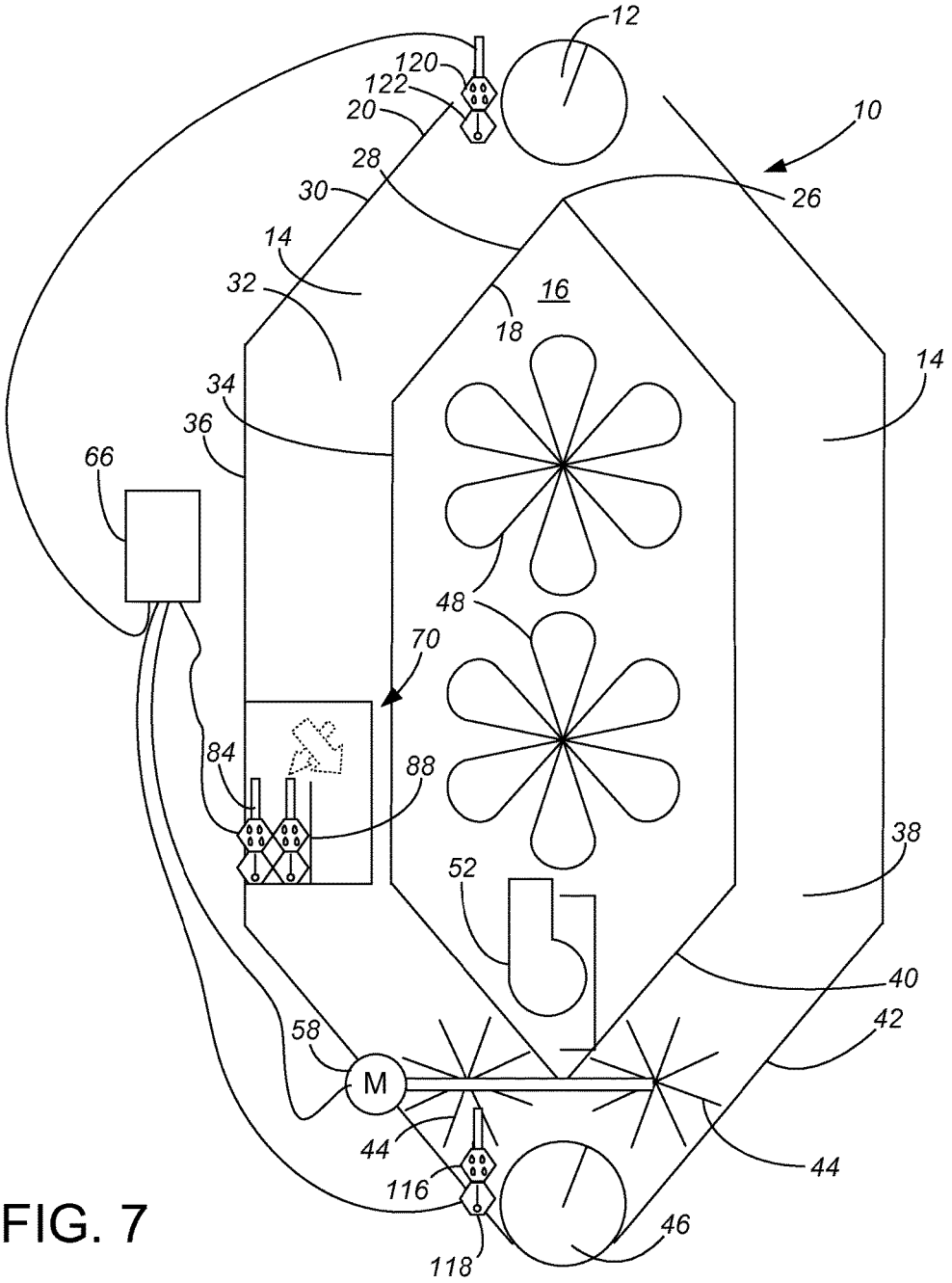
FIG. 7 is a schematic view showing the retrofit system of FIGS. 2-6.

The dryer 10 has a forced air heating system for forcing heated air across grain in the pathways 14. Air is drawn axially into the heating chamber 16 such as by one or more fans 48 on a housing 50. The forced air is heated by a burner unit 52 (shown schematically in FIG. 7) or other heater within the central dryer chamber 16, possibly circulated with a stationary angled fin plate 54. The heated air moves radially outward from the plenum 16 through the grain in the pathway 14. The cross-flow of the heated air draws moisture out of the grain in the grain pathway 14. The rate of moisture removal depends on many factors, including the initial relative humidity of the air, the initial and heated temperatures of the air, the initial moisture content of the grain, the rate of air flow, the rate of grain flow, the initial temperature of the grain, the type of quality of grain being dried, etc.

An electrical panel 56 is provided for providing electric power to the fans 48, the motor for the augur 46 and the motor 58 (shown schematically in FIG. 7) for the metering rolls 44, possibly also powering an electrical light 60 or other electrical components. In older grain dryers, there may be no control system present, and the speed of the metering rolls 44 may be constant or manually settable without changing based upon any sensed measurements. On newer grain dryers, a weatherproof cabinet 62 may house a control panel 64 for running a controller/processor 66 of the control system. Alternatively, newer grain dryers may place the controller/processor 66 within the electrical panel 54. The entire dryer 10 may be supported on a frame 68.

The dimensions of the grain dryer 10 depend upon the particular manufacturer and model of the unit, but typically fall within accepted practical ranges. In common grain dryers, the grain pathways 14 are about 12 to 14 inches thick, and the vertically extending portion from the lower shoulder 38 to the upper shoulder 32 typically extends anywhere from about 12 to 26 feet.

If the existing grain dryer has no control system, then significant fuel savings and/or a higher quality, more consistently dried product can be achieved by adding a control system to the dryer. However, such existing grain dryers were engineered without structure or design to enable a control system to be added, which can make adding a control system quite challenging. If the existing grain dryer 10 has a control system, there is a significant possibility that the control system may not operate accurately or efficiently based upon its design. There is also a significant possibility that the existing control system may have malfunctioned or be in a state of disrepair, requiring replacement. Most grain dryer manufacturers have not designed control systems or grain dryers with an emphasis on ease of repair or replacement of the control system.

The present invention is a moisture control system intended to be used in retrofitting existing grain dryers. Two of the primary components in the retrofit system are conventional and can be found in existing units such as shown in FIG. 1. Namely, the retrofit system of the present invention utilizes a controller/processor 66 and a motor for the metering rolls 44 such as found in prior art systems. For instance, the preferred controller/processor 66 is an Allen Bradley 1400 processor and associated cards with an Allen Bradley color touch screen—human interface 64, driving an alternating current, three phase motor 58 (typically C face mount) coupled to the metering rolls 44 with an Allen Bradley—Variable Frequency Drive (VFD). The third primary component in the retrofit system is the turner and sensor unit 70 best depicted in FIGS. 2-5.

The controller/processor 66 is programmed and runs a control algorithm generally as known in the art for setting the speed of the metering rolls 44. In particular, the control algorithm drives the metering rolls 44 on a P-I-D (proportional-integral-derivative) algorithm toward a desired moisture set point. For corn, typical desired moisture set points are about 15 or 16%. While the turner and sensor unit 70 shown in FIGS. 2-5 could be installed to work with controller/processors and metering roll motors existing in the field, retrofitting the existing grain dryer 10 with all three primary components avoids many compatibility and programming issues. That is, when sold as part of the retrofit system, the controller/processor 66 will be preprogrammed to receive and assess the type of signals provided by the sensor (typically 4-20 mA or 0-12 Vdc, as determined by the sensor manufacturer) and to provide the type of signal (typically, a 0-24 Vdc control signal, as determined by the motor manufacturer) required of the motor 58 for the metering rolls 44. Then a simple calibration routine can be run on the retrofit system to ensure that the motor speed converts into the desired throughput time of each pathway 14 through the dryer 10. Further, most existing systems utilize direct current motors to drive the metering rolls 44 which are subject to frequent breakdowns, and replacing the direct current motor with an alternating current motor 58 tends to create a more robust system.

Figure 6:
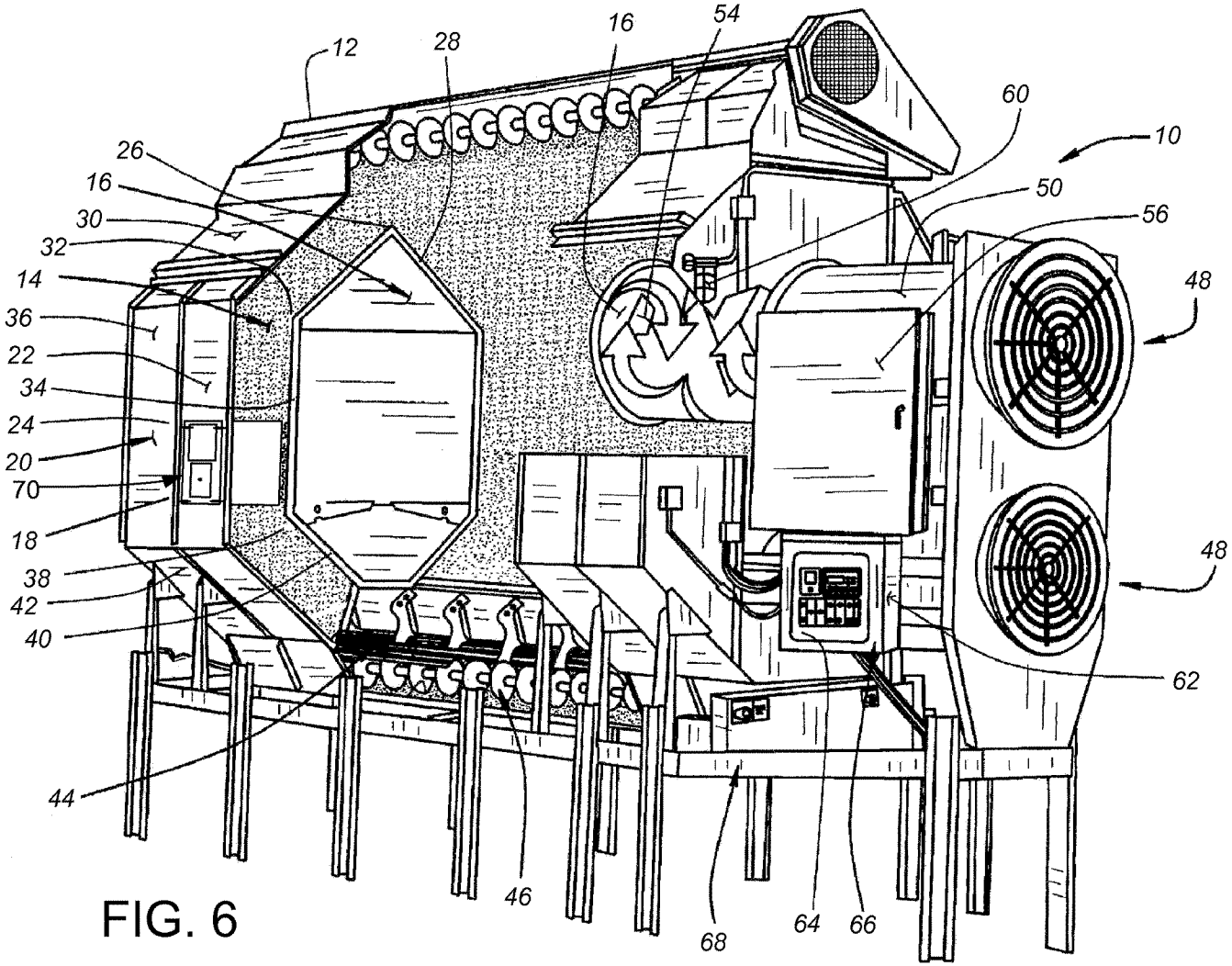
FIG. 6 is a perspective view showing the turner and sensor unit of FIGS. 2-5 installed in the grain dryer of FIG. 1.

The turner and sensor unit 70 includes a front face 72, with a mounting configuration for attachment so the front face 72 can be installed essentially coplanar with one of the outer vertical side panels 36 between two of the columns 24 as shown in FIG. 6. In the preferred embodiment, the mounting configuration includes two vertically extending mounting beams 74. Slide pins 76 are welded to the mounting beams 74, extending horizontally inwardly across the front face 72 of the turner and sensor unit 70. The slide pins 76 mate into respective slide collars 78 which are welded onto the front face 72. Bolt holes 79 are formed in the mounting beams 74, for bolting into a column 24. The side walls 80, 82 of the preferred turner and sensor unit 70 are 18 inches high, 12 inches deep, spaced 8 inches apart. The slide pins 76 allow the mounting beams 74 to be moved inward and outward into the slide collars 78, so the turner and sensor unit 70 can be attached directly to columns 24 spaced anywhere from 11 to 16 inches apart. Alternatively, other mounting configurations can be used. However, to preserve the structural integrity of the dryer 10, the turner and sensor unit 70 should fit between two adjacent columns 24 so it can be installed without having to cut through or remove any of the columns 24.

The turner and sensor unit 70 includes a sensor 84 with a detachable electrical plug/socket connection 86 so the electrical signals provided by the sensor 84 can be communicated to the controller/processor 66. As shown schematically in FIG. 7, the preferred sensor 84 is a plate sensor housing two capacitive humidity sensors and two temperature sensors. U.S. Pat. Nos. 6,192,750 and 6,249,130 describe capacitive moisture sensors and are incorporated by reference. By having two capacitive humidity sensors and two temperature sensors, each of the sensor readings can be verified against the other. If the readings from one of the pairs of sensors differs significantly from the other, that's a clear indication that there is either significant buildup of foreign matter on the plate sensor 84, or that one of the sensors is beginning or completely malfunctioning. The controller/processor 66 alerts the user of a sensing failure if a difference between readings from the two sensors is outside of a preset tolerance. The indication of a malfunctioning sensor 84 is very important to maintain the highest fuel efficiency and quality of drying in the dryer 10.

In the preferred model (similar to single humidity/single temperature plate sensors provided by Agri-Chem), the plate sensor 84 has dimensions of about 4 inches×8 inches×0.25 inches. The plate sensor 84 is aligned relative to the outer vertical side panel 36, so it is parallel to the flow of the grain. More particularly, capacitive plates within the sensor 84 are thereby oriented parallel to the grain flow direction. A space defining wall 88 extends vertically in the turner and sensor unit 70 between the side walls 80, 82, such that the space defining wall 88 is in a parallel configuration with the plate sensor 84. The space defining wall 88 creates a defined space 90 in which the capacitive measurement of the moisture is taken, which should have a depth less than one half of the total depth of the pathway 14. In the preferred embodiment, the defined space 90 is within the range of 2½ to about 7 inches deep, such as a depth of 5 inches, and the capacitive moisture measurement of the grain occurs in the 5 inch thick space 90 between the plate sensor 84 and the space defining wall 88.

The plate sensor 84 is provided on the inside surface of a hinged door 92 which is accessible from outside the unit 70. By being located on the outside of the unit 70, the electrical plug/socket 86 is always accessible for checking the electrical connections. By being attached on a hinged door 92, the plate sensor 84 can be readily accessed, cleaned and replaced if necessary. A locking mechanism 94 can be used to keep the door 92 shut when the unit 70 is in operation. For instance, while the locking mechanism 94 can be a simple clip or latch, in one embodiment the locking mechanism 94 is a threaded stud (not shown) welded onto the front face 72, and a wing nut (not shown) is used to secure the door 92 closed.

The top half of the turner and sensor unit 70 is the grain turner 96. The grain turner 96 moves grain from the air upstream side to an air downstream side in the pathway 14 and simultaneously moves grain from the air downstream side to an air upstream side in the pathway 14. The function of the grain turner 96 is to transfer a portion of grain from out of the center of the pathway 14 into the defined space 90. This allows the sensed humidity to be more representative of the entire pathway 14 of grain rather than to be more heavily weighted by the inside or outside of the pathway 14. The preferred grain turner structure is formed of five plates within the turner and sensor unit 70: four ramps 98, 100, 102, 104 and a divider 106. The divider 106 extends vertically, parallel to the front face 72. The divider 106 is triangular in shape with its top edge running horizontally and splitting the grain into a front portion and a center portion. In the front portion, a rightward ramp 98 and a rearward ramp 100 act jointly to force the grain falling in the front portion to move rightwardly and rearwardly, under the divider 106 (and under a leftward ramp 102 and then behind the space defining wall 88. In the center portion, the leftward ramp 102 and a frontward ramp 104 act jointly to force the grain falling in the center portion to move leftwardly and frontwardly, under the divider 106 (and under the rightward ramp 98) and into the defined space 90 for humidity and temperature sensing. In the preferred embodiment, the ramps 98, 100, 102, 104 all have a slide angle of about 50° to horizontal (i.e, slightly more vertical than horizontal) for moving the grain as it travels down the pathway 14.

Figure 3:
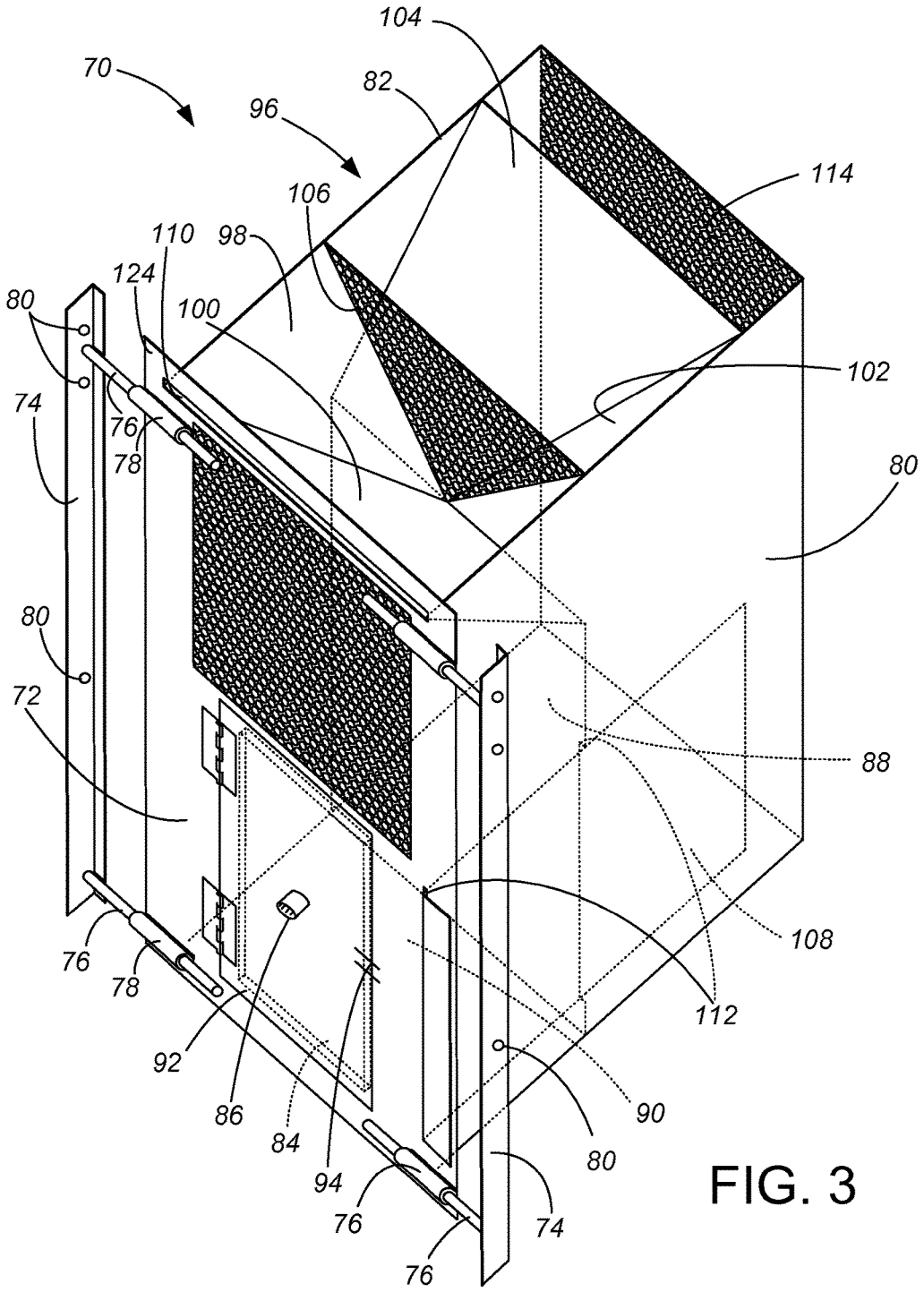
FIG. 3 is a perspective view of the turner and sensor unit of FIG. 2, taken at a steeper angle and using dashed lines to show hidden interior structure.
Figure 4:
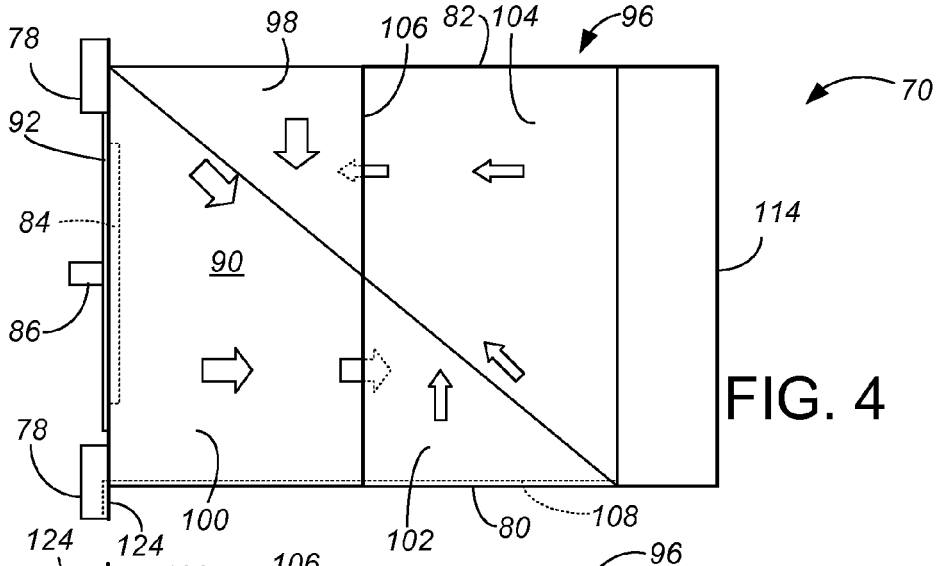
FIG. 4 is a top plan view of the turner and sensor unit of FIGS. 2 and 3, without the mounting beams and additionally with arrows to show the gravitational direction of flow of the grain.
Figure 5:
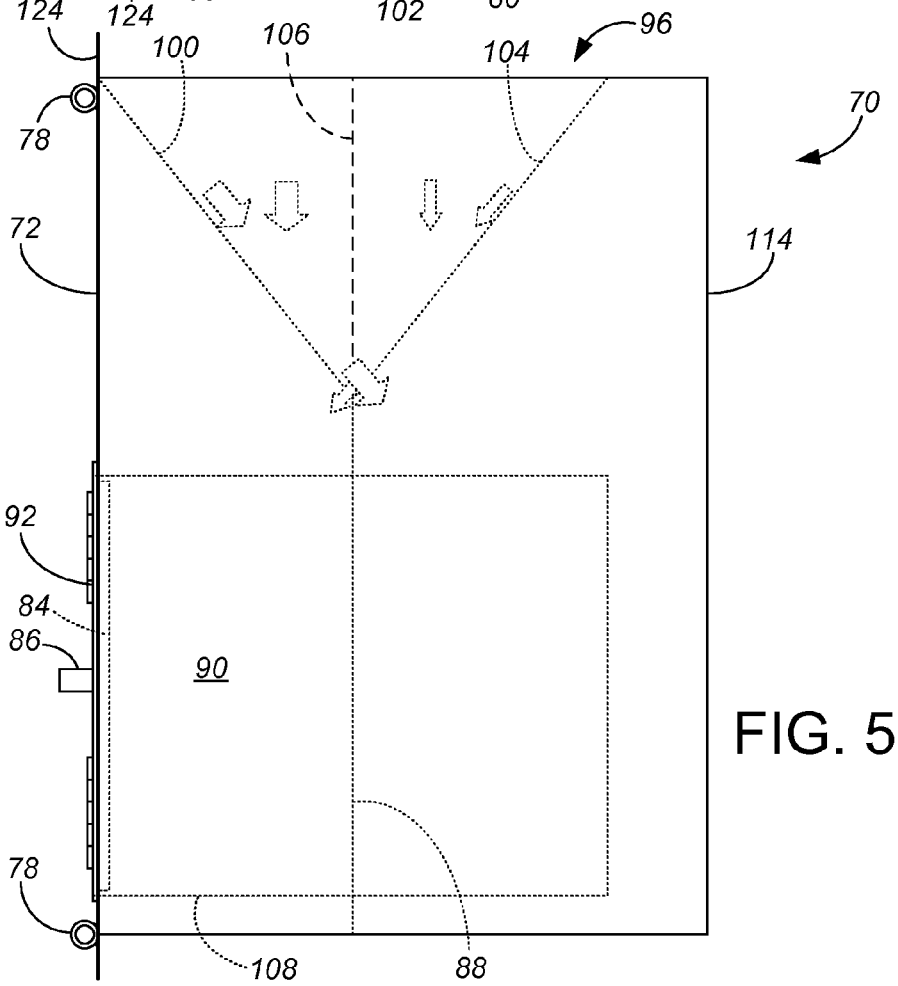
FIG. 5 is a side elevation view of the turner and sensor unit of FIGS. 2-4.

As noted earlier, the plate sensor 84 is on a hinged door 92 at the front of the defined space 90. However, if this door 92 is opened during operation, grain will pour out of the door opening. The preferred turner and sensor unit 70 has a shield 108 which can be used to keep this from happening. A shield slot 110 through the front face 72 allows the shield 108 to be inserted so it can cover the front portion and the center portion. Thus, whenever the door 92 needs to be opened, rather than requiring the entire dryer 10 to be drained of grain, the operator can merely insert the shield 108 into the shield slot 110 and work the shield 108 backward all the way into the grain column. With the shield 108 in place, the door 92 can be opened and only a few quarts of grain will pour out of the door opening. Alternatively, after the shield 108 is in place, the discharge auger 46 can be run for a short period of time, emptying grain from the defined space 90, at which point the door 92 can be opened without spilling any grain. As best shown in FIGS. 3 and 4, the front face 72 and the space defining wall 88 both have a shield stow slot 112 extending vertically so the shield 108 can be stowed during normal operation of the dryer 10.

The preferred turner and sensor unit 70 also has a rear portion defined by the rear wall 114 behind the frontward ramp 104. This rear portion keeps grain behind the space defining wall 88 even when the shield 108 is covering the front portion and the center portion.

In some dryers, the turner and sensor unit 70 will extend through the full depth of the grain pathway 14 to make contact with the inner vertical panel 34. In other dryers, the grain pathway 14 may be several inches deeper than the turner and sensor unit 70, and spacers (not shown) may be used for contact and/or attachment with the inner vertical panel 34. The contact and/or attachment with the inner vertical panel 34 helps to support some of the weight of the turner and sensor unit 70, particularly when the shield 108 is in place and the turner and sensor unit 70 is solely supporting the weight of grain above it.

Other than the sensor 84, the preferred turner and sensor unit 70 is fabricated from stainless steel, mostly from steel sheet material such as at a thickness of about 0.10 inches. The back face 114, the divider 106 and part of the front face 72 are formed from perforated stainless sheet stock, while the remaining walls 80, 82, 88 are solid stainless sheet stock. Fabricating at least some of the turner and sensor unit 70 from perforated panels enables air movement through the turner and sensor unit 70, but at least the space dividing wall 88 should be continuous to properly define the space 90 for capacitive measurement In the preferred embodiment, the mounting beams 74 are somewhat thicker, such as about 0.14 inches, while the shield 108 is somewhat thinner, such as about 0.07 inches.

If desired, an additional calibration verification can be provided by adding an endpoint moisture sensor 116 and the endpoint temperature sensor 118 (shown in FIG. 7, but optional in use) adjacent the discharge 46 of the grain dryer 10. The discharge sensors 116, 118 are used to calculate the actual final moisture content of the grain, which can be compared to a value that the operator entered into the control panel 64, to verify that grain drying is reaching the desired set point. More commonly, the discharge sensors 116, 118 are not used in the control algorithm but rather are used to monitor and record final moisture content values, preserving the recorded values for a prolonged period of time. Separately or in addition, an endpoint moisture sensor 120 and an endpoint temperature sensor 122 (shown in FIG. 7, but optional in use) can be mounted adjacent the intake 12 of the grain dryer 10. The intake sensors 120, 122 check the initial condition of grain prior to drying, to predict the increased moisture of the incoming commodity. The preferred embodiment, however, omits both the discharge sensors 116, 118 and the intake sensors 120, 122 and performs all calculations based upon the readings taken from the sensor 84 of the turner and sensor unit 70.

In addition to the controller/processor 66, the motor 58 for the metering rolls 44, and the turner and sensor unit 70, a full retrofit package includes:

- Inline sensor housing—10" tube with DAFR (grain funnel) and door mount.
- One 240V to 120V transformer—Isolated power for entire panel
- One 120V to 24 VDC transformer to power the Allen Bradley touch screen
- One 120V to 10 VDC transformer to power the sensors
- Multiple terminal strips—wire connections to components and input signals from dryer
- One Hoffman composite enclosure 62,—NEMA 4× to hold the electronic equipment
- One Hoffman raised door for face of enclosure. Provides access to touch screen 64 (human interface) but keeps rest of electrical components out of the elements.
- One Hoffman cabinet heater with thermostat. This will help to climate control the enclosure interior.
- Fuse holders and fuses in the main disconnect used to limit the short circuit current available to the components in the control cabinet.
- Breakers for cabinet heater, Variable frequency drive, 240 to 120 transformer, power supplies, panel for GFCI outlet and processor are included to electrically disconnect each component and/or limit the incoming current to that component.

Given the configuration of the turner and sensor unit 70, the method of retrofitting a grain dryer 10 and using the moisture controller of the present invention is relatively straightforward. An opening or hole is cut in one of the vertical panels 36 in the location desired for the turner and sensor unit 70, preferably on the side of the dryer 10 with the least amount of other electrical wiring. If possible try to locate the hole on a South or East side of the dryer 10, out of a normal prevailing wind direction. The hole is slightly above the lower shoulder 38, and placing it at a position from 40% to 80% and more preferably from 60% to 80% of the grain flow travel path from the intake 12 to the discharge 46 through the grain dryer 10.

In other examples of existing grain dryers, the positioning of the turner and sensor unit 70 (counting fans from the top of the dryer downward), is:

Four fan stack dryer—locate the top of the turner and sensor unit 70 at the floor break between fans three and four. Eight inches of the grain turner 96 will be located in the fan section #3 to keep the top of the sensor 84 even with the floor.

Three fan stack dryer—locate the top of the turner and sensor unit 70 at the floor break between fans two and three. Eight inches of the grain turner 96 will be located in the fan section #2 to keep the top of the sensor 84 even with the floor.

Two fan dryer—locate the top of the turner and sensor unit 70 at the floor break between fans one and two. Eight inches of the grain turner 96 will be located in the fan section #1 to keep the top of the sensor 84 even with the floor.

Single fan dryer—locate the top of the turner and sensor unit 70 about seventy five percent of the way through the dryer column, twenty five percent of the column will be remaining under the sensor 84 as the commodity moves towards the exit or metering rolls 44. Keep the sensor 84 on the vertical column just above the lower shoulder 38.

Vacuum cool style drier—locate the entirety of the turner and sensor unit 70 above the heating/cooling break point, so the turner and sensor unit 70 sits fully in the heating section, but toward the bottom of the heating section.

The hole should be slightly smaller than the front face 72, but larger than the height and spacing of the side walls 80, 82 of the unit 70, so the unit 70 can be pushed back into the dryer 10 with the front face 72 flush with the remainder of the vertical panel 36. In the preferred embodiment, this is an 8 inch wide by 18 inch tall rectangular opening.

The front face 72 has a peripheral flange 124 which holds the vertical panel 36 around the opening from bending outward under the force of the grain. The mounting beams 74 are extended outwardly to the width of the columns 24, and are bolted to the columns 24 to support the weight of the turner and sensor unit 70. If desired, additional attachment points may be secured to either the inside or outside vertical panels 34, 36. For instance, in the preferred embodiment the mounting flange 124 of the front face 72 is about 1 inch wide, and the outside vertical panel 36 is caulked behind the mounting flange 124.

The sensor 84 is electrically connected to the controller/processor 66, which is in turn electrically connected to the motor 58 for the metering rolls 44. The unit 70 is then fully calibrated and used in drying grain.

The present invention thus provides an efficient and robust solution for retrofitting existing grain dryers with a control system. The sensor 84 is in a convenient location for electrical access, for cleaning and for replacement. Even in this convenient location, the turner 96 moves grain so the sensor 84 senses a central portion of the grain pathway 14 in a defined space 90, for controlled and accurate readings. The system as a whole includes redundancies which provide an indication if sensed readings are not accurate. The turner and sensor unit 70 is installed in a simple manner, mostly supported by the columns 24 on the outside of the dryer 10.

Although the present invention has been described with reference to preferred embodiments, workers skilled in the art will recognize that changes may be made in form and detail without departing from the spirit and scope of the invention.

The invention claimed is:

1. A method of retrofitting an existing grain dryer with a moisture controller system, the grain dryer having a grain pathway defined between exterior and interior panels and between an intake and a discharge, the grain dryer having a forced air heating system for forcing heated air across grain in the grain pathway, the method comprising:

cutting an opening in an exterior panel of the existing grain dryer, at a position within the grain flow travel from the intake to the discharge through the grain dryer;

inserting a unit into the opening and into the grain pathway, the unit having a moisture sensor and a temperature sensor configured to sense moisture and temperature of a central portion of the grain pathway within a defined space, wherein the moisture sensor and the temperature sensor are mounted on a hinged door on a front face of the unit, and wherein the unit further comprises a shield for stopping grain flow within the defined space prior to opening the hinged door; and electrically connecting the moisture sensor and the temperature sensor to a controller configured to drive a grain mover at a controlled speed based upon the sensed moisture and temperature, with the grain mover establishing the rate of grain movement in the grain pathway.

2. The method of claim 1, wherein at least a portion of the unit is fabricated from perforated panels to enable air movement through the unit.

3. The method of claim 1, further comprising adjusting width of a mounting configuration of the unit and mounting the unit to vertical columns in the existing grain dryer.

4. The method of claim 1, further comprising installing a second moisture sensor and a second temperature sensor for sensing moisture and temperature of grain in the defined space.

5. The method of claim 1, further comprising bolting the unit to vertical columns of the existing grain dryer on opposing sides of the cut opening.

6. The method of claim 1, wherein the unit comprises a grain turner, wherein the moisture sensor and temperature sensor are provided as a plate sensor in the unit, with the plate sensor on a front face of the unit, with the grain turner moving grain in the central portion of the grain pathway forward into the defined space.

7. The method of claim 1, further comprising installing a grain turner for moving grain from an air upstream side in the grain pathway to an air downstream side in the grain pathway, and for moving grain from an air downstream side in the grain pathway to an air upstream side in the grain pathway, wherein the moisture sensor and the temperature sensor sense the grain moved by the grain turner to the air downstream side, and wherein the moisture sensor and the temperature sensor are coupled to the grain turner in the unit.

8. The method of claim 1, wherein the moisture sensor and the temperature sensor sense grain moisture and grain temperature within a defined space having a depth less than one half of the total depth of the grain flow.

9. The method of claim 1, wherein the defined space is within a range of about 2½ to about 5 inches in depth.

10. The method of claim 1, further comprising:

installing an endpoint moisture sensor and an endpoint temperature sensor positioned adjacent either the intake or the discharge of the grain dryer.

11. The method of claim 10, wherein the endpoint moisture sensor and the endpoint temperature sensor are adjacent the discharge of the grain dryer.

12. The method of claim 11, further comprising installing a second endpoint moisture sensor and a second endpoint temperature sensor, wherein the second endpoint moisture sensor and the second endpoint temperature sensor are adjacent the intake of the grain dryer.

13. The method of claim 10, wherein the endpoint moisture sensor and the endpoint temperature sensor are adjacent the intake of the grain drying.

14. The method of claim 1, wherein the controller and grain mover establish the rate of grain movement in the grain pathway on a P-I-D algorithm toward a set point.

15. The method of claim 1, wherein the moisture sensor is a capacitive moisture sensor with capacitive plates oriented parallel to the grain flow direction.

16. A method of retrofitting an existing grain dryer with a moisture controller system, the grain dryer having a grain pathway defined between exterior and interior panels and between an intake and a discharge, the grain dryer having a forced air heating system for forcing heated air across grain in the grain pathway, the method comprising:

cutting an opening in an exterior panel of the existing grain dryer, at a position from 40% to 80% of the grain flow travel from the intake to the discharge through the grain dryer;

inserting a unit into the opening and into the grain pathway, the unit having a moisture sensor and a temperature sensor configured to sense moisture and temperature of a central portion of the grain pathway within a defined space, wherein the moisture sensor and the temperature sensor are mounted on a hinged door on a front face of the unit, wherein the unit further comprises a shield for stopping grain flow within the defined space prior to opening the hinged door; and electrically connecting the moisture sensor and the temperature sensor to a controller configured to drive a grain mover at a controlled speed based upon the sensed moisture and temperature, with the grain mover establishing the rate of grain movement in the grain pathway.

17. A method of retrofitting an existing grain dryer with a moisture controller system, the grain dryer having a grain pathway defined between exterior and interior panels and between an intake and a discharge, the grain dryer having a forced air heating system for forcing heated air across grain in the grain pathway, the method comprising:

cutting an opening in an exterior panel of the existing grain dryer, at a position from 40% to 80% of the grain flow travel from the intake to the discharge through the grain dryer;

inserting a unit into the opening and into the grain pathway, the unit having a moisture sensor and a temperature sensor configured to sense moisture and temperature of a central portion of the grain pathway within a defined space;

electrically connecting the moisture sensor and the temperature sensor to a controller configured to drive a grain mover at a controlled speed based upon the sensed moisture and temperature, with the grain mover establishing the rate of grain movement in the grain pathway; and installing a second moisture sensor and a second temperature sensor for sensing moisture and temperature of grain in the defined space, wherein the controller monitors data received from the moisture sensor and the second moisture sensor and monitors data received from the temperature sensor and the second temperature sensor, wherein a difference between readings outside of a preset tolerance indicates a sensing failure.

18. The method of claim 17, wherein the moisture sensor and the temperature sensor are mounted on a hinged door on a front face of the unit.

19. The method of claim 18, wherein the unit further comprises a shield for stopping grain flow within the defined space prior to opening the hinged door.

* * * * *